US005813920A

United States Patent [19]

Rife

[11] Patent Number: 5,813,920

[45] Date of Patent: Sep. 29, 1998

[54] GOLF CLUB GRIP WITH CONSTANT OUTSIDE DIAMETER

[76] Inventor: Guerin D. Rife, 1310 S. Pennsylvania Ave., Winter Park, Fla. 32789

[21] Appl. No.: 632,114

[22] Filed: Apr. 15, 1996

[51] Int. Cl.[6] ..... A63B 53/14

[52] U.S. Cl. ..... 473/300

[58] Field of Search ..... 473/300, 301, 473/302, 303, 304, 201, 202, 203, 204, 206, 207; 273/67 DA, 67 DB, 73 J, 67 A

[56] References Cited

U.S. PATENT DOCUMENTS

| | | | |
|---|---|---|---|
| 740,500 | 10/1903 | White | 473/300 |
| 1,012,299 | 12/1911 | True | 473/300 |
| 1,626,967 | 5/1927 | Reach | 473/301 |
| 3,606,326 | 9/1971 | Sparks | 473/300 |
| 4,310,158 | 1/1982 | Hoffman | 473/204 |
| 4,597,578 | 7/1986 | Lancaster | 473/300 |
| 4,746,120 | 5/1988 | Mockovak | 473/301 |
| 4,964,192 | 10/1990 | Marui | 473/203 |

*Primary Examiner*—Sebastiano Passaniti
*Attorney, Agent, or Firm*—Aquilino & Welsh

[57] ABSTRACT

A round golf club grip for woods, metalwoods and irons having an outer surface with a constant diameter from the cap end to the opposite opening end.

3 Claims, 1 Drawing Sheet

2
14
15
11
3
3
L
10
d1
13
16
2

14
15
d2
10
18
d2
12
13
16

10
16
18

114
115
120
100
111
113

GOLF CLUB GRIP WITH CONSTANT OUTSIDE DIAMETER

BACKGROUND AND SUMMARY OF THE INVENTION

The present invention relates to golf club grips and, more particularly, to golf club grips having an improved gripping surface.

Conventional golf club grips used for wood, metalwood and iron type golf clubs have tapered outer surfaces in order to conform with the tapered shape of the handle portion of the golf club shaft. These grips have a larger outer diameter toward the cap end of the golf grip and they gradually decrease in diameter toward the open end. Holding a golf club in a normal manner, a golfer's fingers closest to the thumbs are holding a smaller grip diameter than the opposite fingers of the same hand. Furthermore, the lower hand will grip a smaller diameter portion of the golf club grip than the upper hand. It has been found that there are advantages in feel and control if the golf grip has a uniform diameter along its entire length whereby all of the fingers of each of the upper and lower hands engage a portion of the grip having the same diameter.

The present invention provides a golf club grip having a pre-molded shape with a constant outer diameter along its entire length, a gradually increasing inner diameter to accommodate the taper of a conventional golf club shaft and a wall thickness progressively thicker toward the opening end of the grip.

Among the objects of the present invention are the provision of a golf club type grip having a constant diameter gripping surface along the entire length of the grip.

Another object of the present invention is the provision of a golf club grip wherein all of the fingers of each hand engage the same outside diameter along the entire length of the grip providing an identical feel for each finger.

Other objects will become apparent with reference to the following detailed specification description and accompanying drawings.

DESCRIPTION OF THE PREFERRED EMBODIMENTS

Figures 1, 2, 3, 4:
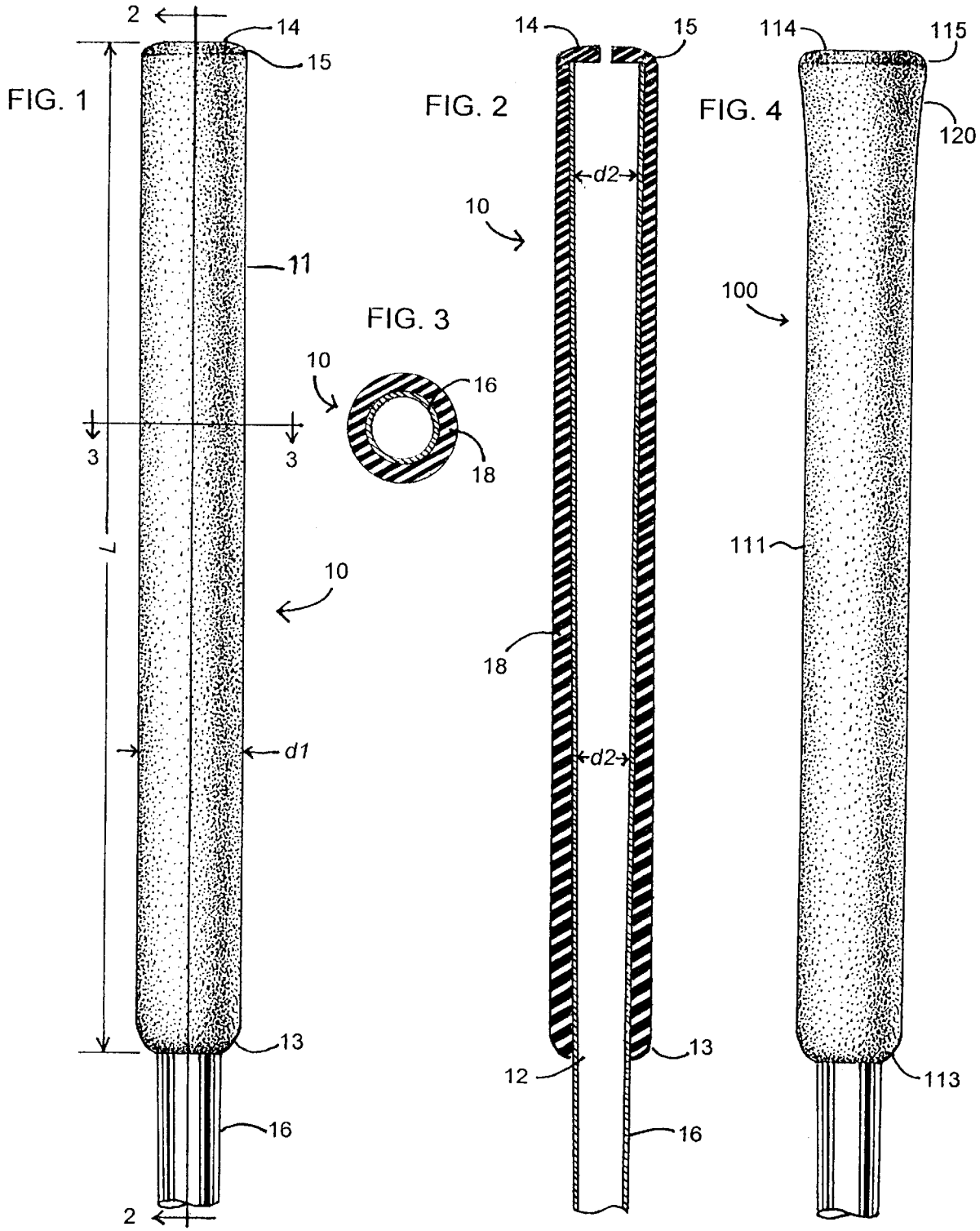
FIG. 1 is an elevational view of a golf club grip in accordance with the present invention.
FIG. 2 is a sectional view taken along the line 2—2 of FIG. 1.
FIG. 3 is a sectional view taken along the line 3—3 of FIG. 1.
FIG. 4 is an elevational view of an alternate embodiment of the golf grip in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The golf grip of the present invention is designed to be used with wood, metalwood, and iron type golf clubs. The golf grip provides a gripping surface on the upper handle portion of a golf club having a gripping surface with a round outer surface having a constant outer diameter along its entire length, unlike conventional round golf grips for these type of golf clubs which taper and become gradually smaller away from the butt end toward the club head end of the golf club in order to accommodate tapered golf club shafts.

FIGS. 1, 2 and 3 illustrate a golf grip 10 of the present invention which is rounded in section. The grip 10 includes an outer surface 11, an opening 12 at an open end 13 and a cap 14 at an opposite cape end 156. The golf grip 10 has a constant outside diameter d1 extending the entire length L of the grip from end to end. The inside diameter d2 of the grip 10 gradually increases toward the cap end 15 of the grip to accommodate a tapered golf club shaft 16.

As further can be seen from the sectional view of FIG. 2, the thickness of the grip wall 18 is progressively thicker from the cap end 15 toward the opening end 13 in order to maintain the constant outside diameter d1. The golf grip 10 of the present invention provides a uniform gripping surface along the entire length of the golf grip thereby providing the same size gripping surface for the index and middle fingers as for the ring and pinky fingers. This provides a more positive feeling of control as the golf club is swung during the execution of a golf shot.

FIG. 4 illustrates a second embodiment of a golf club grip 100 of the present invention. The grip 100 is the same as the grip described hereinabove except the outer surface 111 includes a slight flare 120 formed near the cap end 115 beginning at the edge of the cap 114 and tapering downwardly a short distance. The remainder of the outer surface 111 of the grip 100 is the same constant diameter to the opening end 113. The flare 120 permits a golfer to obtain a more secure grip by the palm pad of the upper hand particularly when the grip 100 is used in wet or rainy conditions. As with grip 10 described hereinabove, the lower fingers of the upper hand and all of the fingers of the lower hand engage the outer surface of the grip 100 having the same constant diameter. It will be appreciated that the tapered inner diameter of the grip 100 and the wall thickness 118 thereof is the same as the grip 10 except for a slightly thicker wall under the flare 120.

It will be appreciated that the golf grip of the present invention may be provided with a variety of outer surfaces as long as the outside diameter remains constant over its entire length.

Other changes and modifications may be made in keeping within the scope of the following claims.

I claim:

1. A golf club grip for an iron or wood type golf club having a cap end, a cap, an opening end and opening for insertion of a golf club shaft therein; said grip being defined by a round outer surface having a constant outside diameter along the length of the grip from said cap end to said opening end; said opening having an inner diameter being larger in size at said cap end and gradually smaller toward said opening end; and said grip being further defined by a wall thickness which increases from said cap end toward said opening end.

2. The golf club grip of claim 1 being further defined by a flare on said outer surface creating a slightly larger diameter of said outer surface adjacent said cap end.

3. The golf club grip of claim 1 wherein said outer grip surface is round in section along the length of said grip.

* * * * *